United States Patent [19]

Price

[11] 4,388,881

[45] Jun. 21, 1983

[54] HAND-HELD TUFTING MACHINES

[75] Inventor: Herbert B. Price, Hixson, Tenn.

[73] Assignee: Spencer Wright Industries, Inc., Chattanooga, Tenn.

[21] Appl. No.: 271,788

[22] Filed: Jun. 8, 1981

[51] Int. Cl.[3] ..... D05C 15/00

[52] U.S. Cl. ..... 112/80

[58] Field of Search ..... 112/80, 79 R, 79 FF

[56] References Cited

U.S. PATENT DOCUMENTS

| | | | |
|---|---|---|---|
| 2,753,820 | 7/1956 | Lijtig | 112/80 |
| 2,837,045 | 6/1958 | Gifford | 112/80 |
| 2,887,076 | 5/1959 | Sterner | 112/80 |
| 3,142,276 | 7/1964 | Schauer | 112/80 |
| 3,144,844 | 8/1964 | Elliott et al. | 112/80 |
| 4,267,784 | 3/1981 | Heemstra | 112/80 |

*Primary Examiner*—Ronald Feldbaum

*Attorney, Agent, or Firm*—Alan Ruderman

[57] ABSTRACT

A hand-held tufting mending gun has a piston within a cylinder pivotably mounted on a plate, the piston rod being eccentrically connected to a crank pin on a rotatable drive disk. The plate has an inlet port and an outlet port for registering cyclically with a respective port at each end of the cylinder. When an inlet port registers with a cylinder port at one end, the other cylinder port registers with the opposite outlet port. Also eccentrically connected to the drive disk is a needle driving crank arm for reciprocating a shuttle carrying a hollow needle carrier supporting a hollow needle. A high pressure air source fed to the gun housing is directed to the inlet ports and to the needle carrier, the latter for blowing the yarn through the hollow needle. Air entering the inlet ports feeds first one cylinder port and then the other to drive the piston, and exhausts from the unfed end of the cylinder through the cooperating outlet port.

9 Claims, 4 Drawing Figures

HAND-HELD TUFTING MACHINES

BACKGROUND OF THE INVENTION

This invention relates to tufting machines and more particularly to hand-held tufting machines using pneumatic power for driving the reciprocating needle.

Hand-held tufting machines of this general class are universally used as mending tools for correcting faults in tufted fabric such as carpeting. For example, if for some reason, such as a broken yarn, one or two needles of a tufting machine do not form stitching in the fabric, the missing stitches are inserted by the use of the hand-held units known as mending guns. Known prior art mending guns are illustrated in U.S. Pat. Nos. 2,753,820; 2,837,045; 2,887,076; 3,142,276; 3,144,844; 3,225,723; and 3,645,219. Other uses of such guns are found in the manufacture of customized rugs.

Because of the ready availability of a supply of compressed air in carpet mills many, if not most, of the current mending guns are pneumatically driven, the gun having a small pneumatic rotary turbine motor within the handle for reciprocatably driving the needle. However, such a motor is a costly item relative to the cost of the entire gun, being in the range of approximately 50 percent of the overall cost. Thus, it is highly desirable that some alternative means for driving the needle be found.

SUMMARY OF THE INVENTION

The present invention provides a pneumatically powered mending gun that does not use a rotary pneumatic motor. In place of the motor the present invention provides an inexpensive piston drive construction. The piston reciprocates within a pivotably mounted housing that cyclically pivots in alternate directions with each stroke of the piston to open and close air ports in the piston housing for ingress and egress of air therein, the piston being eccentrically connected to a crank that drives the needle. Thus, the piston is double acting and as the piston reaches the end of its stroke at each end of the piston housing, the piston housing has pivoted into a position to receive high pressure air at the end reached by the piston thereby to drive the piston in the reverse direction, and thus the needle. The invention can be applied to conventional mending guns with little modification thereto, and with elimination of the motor at great savings.

According to the principles of the present invention the piston housing is pivotably mounted intermediate the ports on a bracket that includes a pair of spaced ports disposed at opposite ends of the fulcrum, one port of each pair being an inlet and the other being an outlet and being on opposite sides of the normal piston housing center line, each bracket port being disposed to register with the respective housing port when the housing has pivoted to its extreme position at opposite sides of the center line. Compressed air, which is conventionally used for blowing yarn through the hollow needle used in such guns, is directed to each bracket inlet port, the air entering each inlet port communicating with the interior of the piston housing at each end when the respective port is in registration with the adjacent housing port. When the inlet port registers with the housing port at one end, the outlet port at the other end registers with the other housing port. Consequently, pressurized air entering the housing at one end drives the piston in a first direction to drive the crank to which it is eccentrically connected. This pivots the piston housing to a position where the other end communicates with and receives pressurized air, the first end of the piston housing then being disposed for releasing its charge of air to the corresponding exhaust port.

Consequently, it is a primary object of the present invention to provide a simple inexpensive pneumatic needle drive for a hand-held tufting machine and thereby eliminate the need for the relatively expensive rotary pneumatic motor.

It is another object of the present invention to drive the needle of a hand-held tufting machine pneumatically through a piston/cylinder assembly, the assembly being mounted for pivotable movement for porting air alternately to opposite ends of the piston.

It is a further object of the present invention to provide in a hand-held tufting mending gun a piston/cylinder drive assembly, air being supplied to opposite ends of the piston alternately to drive the piston in both directions and the assembly being mounted for movement to port air to the appropriate end of the piston when the piston approaches the limit of its travel at the corresponding end.

It is a still further object of the present invention to provide in a hand-held tufting machine a piston/cylinder drive assembly, the piston being eccentrically connected to a crank for driving the needle of the machine and the piston housing being pivotably mounted on a bracket having inlet and outlet air ports for communicating with the interior of the housing at each end, air being alternatively admitted and exhausted from each end of the piston housing as the housing is caused to pivot by the action of the piston.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
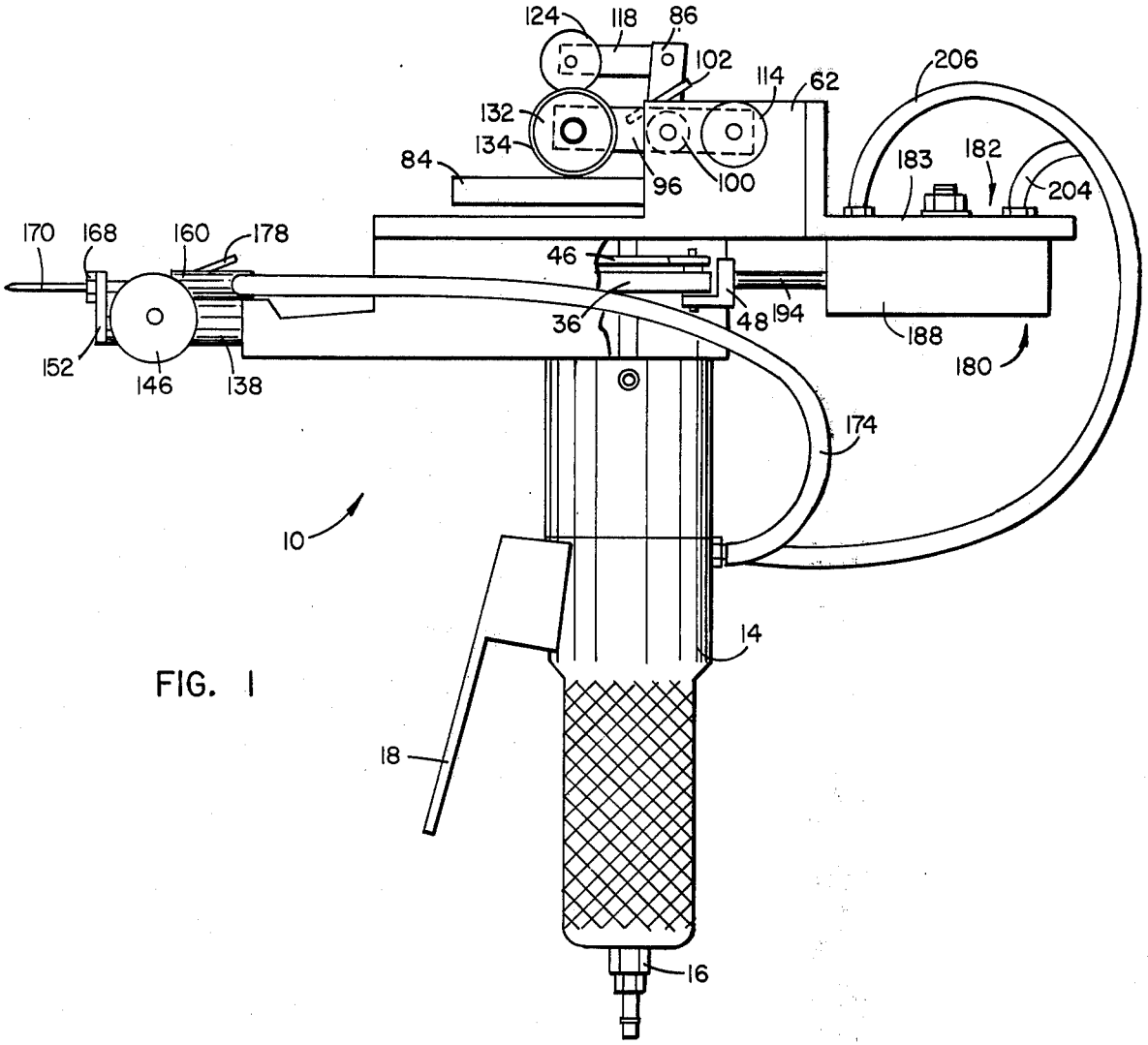
FIG. 1 is a side elevational view of a hand-held tufting mending gun incorporating the features of the present invention.
Figure 3:
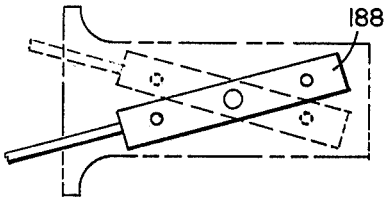
FIG. 3 is a diagrammatic view illustrating the action of the piston/cylinder assembly for valving air for driving the piston.
Figure 4:
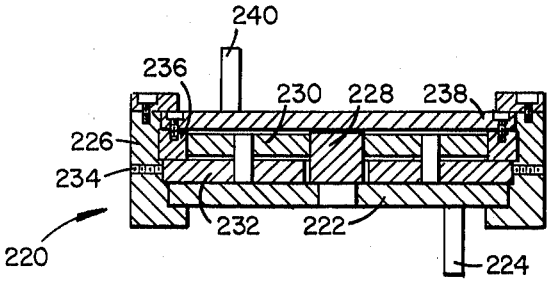
FIG. 4 is a cross sectional view taken substantially through a speed reducing mechanism for reducing the speed of the mending gun needle.
Figure 2:
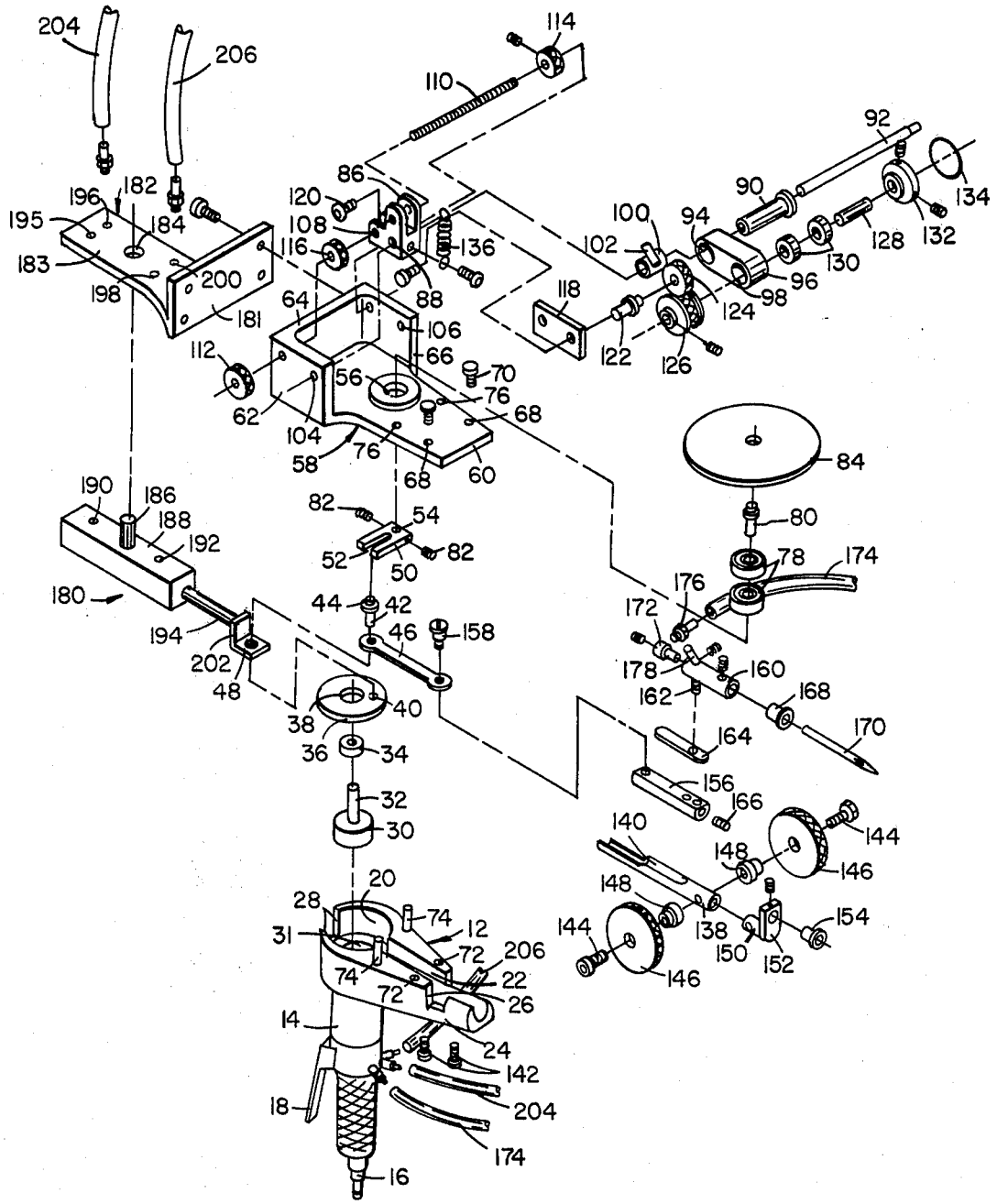
FIG. 2 is a disassembled perspective view of the mending gun of FIG. 1.

Referring to the drawings, a hand-held tufting machine mending gun generally indicated at 10 is illustrated comprising a housing 12 to which a handle 14 is secured. The handle is substantially hollow and includes a fitting 16 at the bottom for connection of the gun to a high pressure source of air. In the prior art mending guns a rotary pneumatic motor (not illustrated) is positioned within the handle and the air flow from the source to the motor is opened and closed by a valve controlled by an operator influenced lever 18. The same or a similar operator influenced lever may be utilized in the handle of the gun of the present invention for opening and closing the passage of high pressure air to the needle carrier and the piston/cylinder assembly as hereinafter described.

The housing 12 is a substantially inverted L-shaped member having a hollow 20 at the top and a tapered open top channel 22 opening into the hollow and extending out the leg 24 of the L-shaped housing 12, the channel being deeper between the hollow and a pair of upright ledges 26 that at the free end of the leg 24. For reasons which will become apparent the wall forming the hollow is open at 28 oppositely to the channel over an angle of approximately 90 degrees. The housing is sealed at the top intermediate the hollow and the interior of the handle and to this end a tight fitting disk-shaped plug 30 having an upstanding pin 32 may be inserted into the top of the housing, the pin extending upwardly into the hollow. It is visualized that rather than a separate plug 30, the housing would have a floor formed between the hollow and the handle 14, such as at 31, and the pin 32 would then be secured to the floor. Positioned about the top portion of the pin 32 is a bearing member 34 of a conventional type such as a ball bearing. A disk 36 having a central aperture 38 fitting about the bearing 36 is positioned for rotation relatively to the pin 32 and includes an eccentrically disposed tapped hole 40.

Threadedly received within the hole 40 of the disk 36 is a crank pin 42 having an enlarged shoulder 44 adjacent the end remote from the disk 36. Journally disposed about the pin 42 between the disk and the shoulder 44 are a pair of crank arms 46 and 48, the pin extending through an aperture in each arm. As hereinafter described, the crank arm 46 is a needle drive crank arm and the crank arm 48 is the disk driving crank arm.

Disposed above the housing 12 is a lever 50 in the form of a substantially rectangular block having a follower slot 52 open at one end of the block. The slot 52 has a width substantially equal to the diameter of the shoulder 44 and is positioned about the shoulder. The block lever 50 also includes an aperture 54 which is aligned with a bore 56 in a housing cover 58 positioned on the housing 12. The housing cover 58 comprises a substantially flat plate member 60 having three upstanding walls 62, 64, 66 in the form of a U-shaped frame at one end thereof, the bore 56 being substantially centrally disposed on the plate 60. A pair of counterbored holes 68 are formed in the plate 60 for receiving a pair of filister head screws 70 which are threadedly received within holes 72 in the top of the housing 12 at opposite sides of the channel 22. A pair of spaced pegs 74 on the top of the housing 12 are received within guide holes 76 formed in the plate 60 to further aid in securing the housing cover 58 to the housing 12. Secured within the bore 56 are the outer races of a pair of ball bearings 78, the inner races thereof securely receiving a shaft 80. The bottom portion of the shaft 80 is received within the aperture 54 of the block 50 and secured by set screws 82, while the upper end of the shaft 80 is threaded and secured to the center of a yarn feed disk 84. Thus, when the disk 36 is rotated so to is the disk 84.

Positioned above the disk 84 between the walls 62, 66 is a yarn feed support member 86 in the form of a substantially L-shaped block, the upstanding leg being bifucated. In the vicinity of the intersection of the legs of the member 86 below the bifucation, the member has a through bore 88 for receiving a support shaft sleeve 90. A support rod 92 is positioned within the sleeve 90 which is also received within a first bore 94 in a feed roller drive support member 96 having a second bore 98 spaced from the first bore. The sleeve 90 after passing through the bore 94 is further received within a yarn guide collar 100 having a tubular guide member 102 fixed to the periphery thereof. The rod 92 extends through a hole 104 in the wall 62 and through the members 86, 100, 96 and 90 intermediate the walls 62, 66, and is threadedly secured into a tapped hole 106 in the wall 66. The lower leg of the member 86 includes a tapped hole 108 spaced from the bore 88 for receiving a threaded rod 110 which is also threaded through the walls 62, 66. A knurled wheel 112, 114 is secured on each end of the rod and a third knurled wheel 116 is threadedly rotatably positioned on the rod 110 interior of and adjacent the wall 62. Thus, loosening the wheel 116 on the rod permits the member 86 to translate laterally as the rod 110 is rotated by means of one of the wheels 112, 114.

A link 118 is secured by a screw 120 between the upstanding bifucated legs of the member 86 and carries a small axle 122 which rotatably supports a knurled idler roller 124. The idler 124 meshes with a knurled drive roller 126 carried on one end of a feed shaft 128 supported by bearings 130 in the bore 98 of the support member 96. The other end of the shaft 128 has a wheel 132 fastened thereto, the wheel 132 having a groove in which on "O" ring 134 is trained. A spring 136 is fastened at one end to the link 118 at the location of the shaft 122, and at its other end to the bottom of the block 86 to urge the link downwardly so the "O" ring engages and rides on the disk 84. The position of the "O" ring on the disk controls the rotational speed of the roller 126 and thus the amount of yarn pulled through the guide 102, the position being controlled by the location of the member 86 of the rod 110.

Secured on top of the leg 24 of the housing 12 in the channel 22 is a hollow substantially cylindrical guide barrel 138 having an elongated open slot 140 along the top parallel to the axis of the barrel. The barrel is secured by screws 142, or the like, tapped into the underside of the barrel but not extending into the hollow. A pair of screws 144 extend through knurled wheels 146 and through axle members 148 and are threadedly received through the sides of the barrel to rotatably mount the wheels 146 on the barrel for guiding the gun as it is fed along the work.

Positioned within the open front end of the barrel 138 is a projecting tab 150 formed on the rear of a needle guide holder 152 having a through aperture within which a needle guide 154 is secured. The guide holder 152 is secured within the barrel by means of the screws 144 which are threadedly received within tapped holes in the tab 150. Received in the rear of the barrel and slidable within the hollow of the barrel is a shuttle 156 which is a cylindrical member having a flat formed on its upper surface. A stud 158 is received within an aperture in the end of the crank arm 46 remote from the connection thereof to the disk 36 and is threadedly received in a tapped hole in the flat surface at the rear of the shuttle 156 so that as the disk 36 rotates the shuttle reciprocates within the barrel 138. A hollow cylindrical needle carrier 160 having a stud 162 extends through a flat spacer 164 and is secured to the shuttle for movement therewith by means of a set screw 166. Secured in the front of the needle carrier 160 is a collet 168 for retaining a hollow needle 170 which extends through the needle guide 154. At the rear thereof the needle carrier 160 receives a valve member 172 which is connected to a hose 174 by means of a hose fitting 176 and a yarn guide 178 is angularly disposed on the needle carrier. Yarn from the nip between the rollers 124, 126 is adapted to be threaded through the guide 178, through the hollow of the needle and out the point, and air from the handle 14, flowing through the hose 174, acts to draw the yarn fed by the rollers 124, 126 through the needle to form loops in the work.

In accordance with the invention the disk 36 is driven by a piston/cylinder assembly 180 mounted on the gun. To this end, an L-shaped bracket 182 is secured at one leg 181 to the rear of the wall 64 of the housing cover 58. The other leg 183 of the bracket 182 includes a substantially centrally disposed aperture 184 for receiving a stud 186 mounted on the top side of a substantially rectangular shaped housing 188 forming the container for the piston of the piston/cylinder assembly 180. The housing 188 preferably is bronze and slidably pivots against the bottom surface of the leg 183, which may include frictionless slide pads (not illustrated) of Teflon or other such material.

Although the housing 188 is rectangular for purposes of sliding, the interior thereof is cylindrical as is the piston, hence it is denoted a piston/cylinder assembly. Formed in the upper surface of the housing 188 are a pair of spaced holes 190, 192 which are substantially aligned along the axis of the housing and the piston rod 194 and open into the interior of the housing. The piston travel within the housing 188 is between the location of the holes 190 and 192 as the outer limits. Similarly sized holes 195, 196, 198, 200 are formed through the leg 183 of the bracket 182, the holes 195, 196 and 198, 200 being spaced substantially equal from the center line of the aperture 184 as the respective hole 190 and 192 is to the center line of the stud 186, so that the hole 190 may be aligned with either of the holes 195, 196 and the hole 192 can be aligned with either of the holes 198, 200. The holes 195 and 198 are disposed on opposite sides of the normal center line of the housing 188 from the holes 196, 200, that normal position being when the stud 186, the piston rod 194 and the axis of the needle drive crank arm 46 are aligned. When the hole 190 is aligned with the hole 195, the hole 192 is aligned with the hole 200, and vise versa. The piston rod 194 may be connected to the disk drive crank arm 48 by an upstanding block member 202 formed with the crank arm 48. First and second air lines 204 and 206 communicating with the housing handle 14 are fitted to respective holes 196, 200 to feed pressurized air into the inlet holes, the holes 195, 198 acting as outlet holes.

It should be clear that when the hole 190 is aligned with the hole 196 air entering the hole 196 is received within the head end of the housing 188 and acts on the head end of the piston to drive the piston and thus the piston rod toward the needle mounted side of the gun. Since the hole 192 is then aligned with the hole 198, air in the piston rod end or tail end of the housing exhausts through the hole 198 to atmosphere. This rotates the disk 36 through the eccentrically mounted pin 42 to drive the needle outwardly from the guide 152. As this occurs the housing pivots relative to the bracket 182 about the stud 186 since the disk, due to momentum, contines to rotate. This changes the alignment of the holes so that the hole 192 becomes aligned with the hole 200 and the hole 195 aligns with the hole 190. Thus, air enters the housing at the tail end of the piston to drive the piston in the opposite direction as air exhausts to atmosphere through holes 190 and 195 from the head end of the housing 188. Thus, the piston drives the disk 38 continuously when air is directed by valve 18 through the hoses 204 and 206.

Since the needle speed of the construction heretofore disclosed is equal to the reciprocating speed of the piston rod 194, it may be too fast for practical mending operation. Thus, it is proposed to include a speed reducer intermediate the piston/cylinder assembly and the needle. To this end the disk 36 is replaced by a reducing box 220 having a first disk 222 including a downwardly extending eccentric crank pin 224 for connecting to the piston crank arm 48. The disk 222 is journally mounted in a housing 226 and includes a sun gear 228 centrally fixedly mounted thereon. The sun gear 228 meshes with one or more planet gears 230 journalled on an intermediate disk 232 fixed to the housing 226 as by set screws 234. The gears 230 mesh with a ring gear 236 having internal teeth journalled in the housing 226 and which is fixed to a driven disk 238. A crank pin 240 is eccentrically mounted on the disk 238 for connecting to the crank arm 46 for driving the needle shuttle 156. Thus, rotation of the disk 222 effects rotation of the disk 238 at a reduced speed relative to the disk 222. By varying the number of teeth on the various gears the speed of the needle can be preselected.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a hand-held tufting gun for use with a high pressure source of air for projecting a loop of pile yarn through a backing material, a frame including air inlet means connected to said high pressure source and air outlet means, an operator influenced member for opening and closing passage of air from said inlet means to said outlet means, a needle-carrying member carried by and mounted for reciprocation relatively to said frame and provided with a hollow needle having a pointed end for piercing the backing material, power drive means for drivingly reciprocating said needle-carrying member, yarn feed means carried by said frame for feeding a supply of yarn to said needle in timed relationship with the reciprocation of said needle, said power drive means comprising a piston including a piston rod operatively connected to said needle carrying member, a piston housing, said piston being mounted within said piston housing for reciprocating between limits defined by the extent of travel of said piston, said piston housing including first and second ports, each port opening into said piston housing outside a respective limit of piston travel, and valve means for cyclicly communicating the first port to said air outlet means and the second port to atmosphere and thereafter communicating the first port to atmosphere and the second port to said air outlet means.

2. In a hand-held tufting gun as recited in claim 1, wherein said power drive means includes a disk mounted for rotation on said frame, power take-off means eccentrically mounted on said disk, and means for connecting said piston rod to said power take-off means.

3. In a hand-held tufting gun as recited in claim 2, wherein said piston housing is pivotably mounted for cyclicly pivoting with the piston for controlling said valve means.

4. In a hand-held tufting gun as recited in claim 2, wherein said valve means includes a valve plate having inlet and outlet ports adapted cyclicly to register with each of said first and second ports, means communicating each of said inlet ports with said outlet means, means for pivotably mounting said piston housing on said valve plate so that each of said first and second ports register with the corresponding inlet port when the piston is at one limit of its travel and with the outlet port when the piston is at the other limit of its travel.

5. In a hand-held tufting gun as recited in claim 4, wherein said yarn feed means comprises means connected to and driven by said power take-off means.

6. In a hand-held tufting gun as recited in claim 4, wherein said needle carrying means is operatively connected to said power take-off means.

7. In a hand-held tufting gun as recited in claim 4, including speed reducing means intermediate said disk and said needle carrying means.

8. In a hand-held tufting gun as recited in claim 4, including yarn guide means communicating with the interior of said hollow needle, said yarn feed means feeding said supply of yarn through said guide means, and means communicating said outlet means with said needle for blowing said supply of yarn through said needle.

9. In a hand-held tufting gun as recited in claim 1, wherein said piston housing is pivotably mounted for cyclicly pivoting with the piston for controlling said valve means.

* * * * *